US011225348B2

(12) United States Patent
Brandt Sanz

(10) Patent No.: US 11,225,348 B2
(45) Date of Patent: Jan. 18, 2022

(54) PROCESS OF MAKING A WATER SOLUBLE POUCH

(71) Applicant: The Procter & Gamble Company, Cincinnati, OH (US)

(72) Inventor: Miguel Brandt Sanz, Tervuren (BE)

(73) Assignee: The Procter & Gamble Company, Cincinnati, OH (US)

( * ) Notice: Subject to any disclaimer, the term of this patent is extended or adjusted under 35 U.S.C. 154(b) by 1683 days.

(21) Appl. No.: 14/719,853

(22) Filed: May 22, 2015

(65) Prior Publication Data

US 2016/0340068 A1 Nov. 24, 2016

(51) Int. Cl.

| | |
|---|---|
| ***B65B 47/00*** | (2006.01) |
| ***B65B 47/08*** | (2006.01) |
| ***B65B 1/02*** | (2006.01) |
| ***B65D 65/46*** | (2006.01) |
| ***B65B 9/04*** | (2006.01) |
| ***C11D 17/04*** | (2006.01) |

(52) U.S. Cl.

CPC ..... *B65B 47/08* (2013.01); *B65B 1/02* (2013.01); *B65B 9/04* (2013.01); *B65B 9/042* (2013.01); *B65D 65/46* (2013.01); *C11D 17/042* (2013.01); *C11D 17/043* (2013.01); *C11D 17/044* (2013.01)

(58) Field of Classification Search

CPC ..... B65B 47/08; B65B 1/02; B65B 9/04

See application file for complete search history.

(56) References Cited

U.S. PATENT DOCUMENTS

| | | | | |
|---|---|---|---|---|
| 3,057,127 | A | 10/1960 | Gex et al. | |
| 3,218,776 | A | 11/1965 | Cloud | |
| 5,080,226 | A | 1/1992 | Hodakowski | |
| 7,125,828 | B2 | 10/2006 | Catlin et al. | |
| 7,677,015 | B2 * | 3/2010 | Kroese | B65B 9/04 53/453 |
| 2002/0137652 | A1 | 9/2002 | Gressel et al. | |
| 2009/0098659 | A1 | 4/2009 | Abhyankar et al. | |
| 2009/0199877 | A1 | 8/2009 | Koch et al. | |
| 2011/0189413 | A1 | 8/2011 | Denome et al. | |
| 2013/0219827 | A1 | 8/2013 | Pallotta | |

FOREIGN PATENT DOCUMENTS

| | | | |
|---|---|---|---|
| DE | 2829889 | A1 | 1/1980 |
| JP | H03132330 | A | 6/1991 |
| JP | H08300463 | A | 11/1996 |

(Continued)

OTHER PUBLICATIONS

Liquid Laundry Deterget Capsules Guidelines on CLP Implementation, Version 1.0, Feb. 27, 2015.*

(Continued)

*Primary Examiner* — Yung-Sheng M Tsui
*Assistant Examiner* — Melody Tsui
(74) *Attorney, Agent, or Firm* — Gary J. Foose

(57) ABSTRACT

A process of making a water soluble pouch including the steps of providing a first mold, providing a water soluble first web carried on the first mold, forming the water soluble web into a compartment by applying a first pressure difference across the water soluble first web at a first maximum temperature and subsequently applying a second pressure difference across the water soluble first web, wherein the second pressure difference is greater than or equal to the first pressure difference.

17 Claims, 4 Drawing Sheets

(56) References Cited

FOREIGN PATENT DOCUMENTS

| | | | | |
|---|---|---|---|---|
| JP | 2013518173 | A | 5/2013 | |
| JP | 2015511915 | A | 4/2015 | |
| RU | 2104643 | C1 | 2/1998 | |
| RU | 2528453 | C2 | 9/2014 | |
| WO | WO 2001/85898 | A1 | 11/2001 | |
| WO | WO 2002/40351 | A1 | 5/2002 | |
| WO | WO 0240351 | A1 * | 5/2002 | ..... B65B 11/50 |
| WO | WO-0240351 | A1 * | 5/2002 | ..... B65B 11/50 |
| WO | WO 2002/060757 | A2 | 8/2002 | |
| WO | WO 2003/031266 | A1 | 4/2003 | |
| WO | WO 2004/002828 | A1 | 1/2004 | |
| WO | WO2008087417 | A1 | 7/2008 | |
| WO | 2014170882 | A1 | 10/2014 | |
| WO | WO2014173802 | A1 | 10/2014 | |
| WO | WO2014173803 | A1 | 10/2014 | |

OTHER PUBLICATIONS

Liquid Laundry Detergent Capsules Guidelines on CLP Implementation, Version 1.0, Feb. 27, 2015 (Year: 2015).*

CLP Implementation Guidelines for Liquid Laundry Detergent Capsules (published Feb. 27, 2015) (Year: 2015).*

International Search Report for International Application Serial No. PCT/US2016/032956, dated Oct. 4, 2016, 14 pages.

Russian Search Report for Application No. PCT/US2016/032956, dated May 18, 2016, 2 pages.

* cited by examiner

PROCESS OF MAKING A WATER SOLUBLE POUCH

FIELD OF THE INVENTION

Process for making water soluble pouches containing a substrate treatment agent.

BACKGROUND OF THE INVENTION

Water soluble pouches for delivering substrate treatment agents, such as dishwashing detergents, laundry detergents, surface cleaning compositions, and laundry treatment compositions, are increasing in popularity globally. Typically, the consumer places the pouch in a compartment in the dishwashing machine or in the drum of a clothing washing machine or bucket of water, the pouch is exposed to water, and the pouch dissolves and releases the treatment agent.

The substrate treatment agent can be a solid or liquid. Some pouches have multiple compartments and liquids in each of the compartments. Some pouches have multiple compartments with one compartment containing a solid and another compartment containing a liquid. Individual compartments of multi-compartment pouches can have different dissolution rates, thereby providing for delivery of the substrate treatment agents within individual compartments at different times during the cycle of the wash.

Typically, marketers of pouches of substrate treatment agents sell a plurality of pouches within a single container. To promote ease of use and minimize waste, the pouches within a container are not individually packaged in secondary packages.

During manufacture and storage of the pouches in a consumer's home, the pouches can be exposed to small amounts of water and humidity. One example of how this can occur in a consumer's home is when the consumer reaches into a container of pouches to retrieve one for use. Her hand may be wet from washing dishes or pre-treating a clothing article. Water or other liquid may drip from her hand onto a pouch within the container. That pouch may sit in the container for weeks or months until it is used. This limited exposure to water or liquid can result in some amount of dissolution of the pouch which can cause a local weakness in the pouch. These local weaknesses can develop into leaks in the pouch during storage or pouches that rupture prematurely when placed in a washing machine or dishwasher.

With these limitations in mind, there is a continuing unaddressed need for water soluble pouches that can maintain their structural integrity during storage and not be prone to premature rupture during use.

SUMMARY OF THE INVENTION

A process of making a water soluble pouch comprising the steps of: providing a first mold (530) comprising a first cavity (570), wherein the first cavity comprises a first porous face (575); providing a water soluble first web (505) carried on the first mold; forming the water soluble first web to form a compartment (580) by applying a first pressure difference across the water soluble first web with the water soluble first web at a first maximum temperature and subsequently applying a second pressure difference across the water soluble first web, wherein the second pressure difference is greater than or equal to the first pressure difference; placing a substrate treatment agent (50) on the water soluble first web; providing a water soluble second web (565); and sealing the first web and the second web to one another to form an enclosed pouch (10) having a chamber (40) containing the substrate treatment agent.

The water soluble first web can be at a second maximum temperature when the second pressure difference is applied. The second maximum temperature can be greater than or equal to the first maximum temperature.

The first pressure difference can be applied by applying a first negative gage pressure to the first porous face and the second pressure difference can be applied by applying a second negative gage pressure to the first porous face, wherein the second negative gage pressure is less than or equal to the first negative gage pressure.

The step of forming the water soluble first web to form the compartment can be performed by thermoforming the water soluble first web to form the compartment.

The step of placing the substrate treatment agent on the water soluble first web can be performed by placing the substrate treatment agent in the compartment.

The process of making a water soluble pouch can further comprise the steps of: providing a second mold comprising a second cavity, wherein the second cavity comprises a second porous face; providing a water soluble third web carried on the second mold; forming the water soluble third web to form a second compartment by applying a third pressure difference across the second porous face with the water soluble third web at a temperature of from about 100° C. to about 135° C.; placing a second substrate treatment agent on the water soluble third web; sealing the second web to the water soluble third web to form an enclosed pouch having a second chamber containing the second substrate treatment agent.

The third pressure difference can be applied by applying a third negative gage pressure to the second porous face.

DETAILED DESCRIPTION OF THE INVENTION

Figure 1:
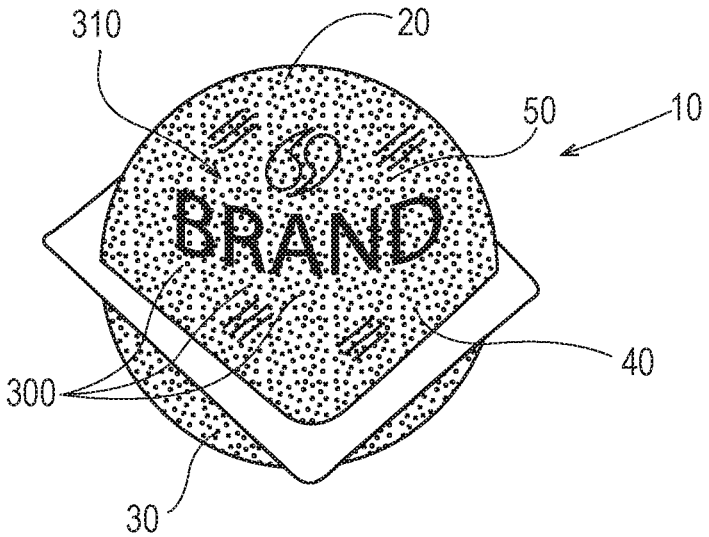
FIG. 1 is a water soluble pouch.

A water soluble pouch 10 is shown in FIG. 1. The water soluble pouch 10 can comprise a water soluble first sheet 20 and a water soluble second sheet 30 joined to the water soluble first sheet 20 to at least partially define a chamber 40 containing a substrate treatment agent 50. As shown in FIG. 1, the water soluble first sheet 20 can comprise a first plurality 310 of printed characters 300.

Figure 2:
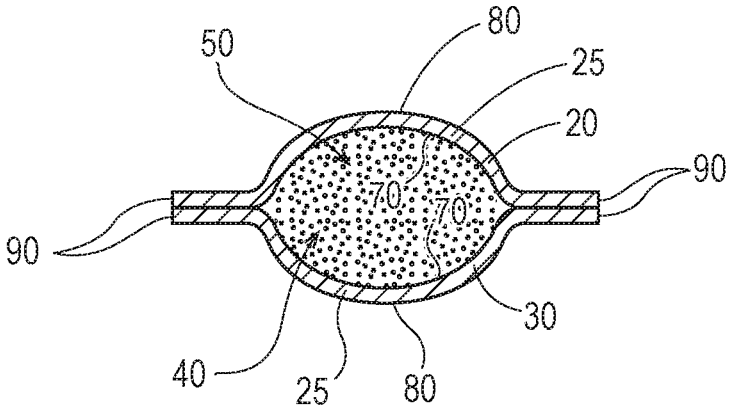
FIG. 2 is a cross section of a water soluble pouch.

Each of the first sheet 20 and second sheet 30 can have an interior surface 70 and an opposing exterior surface 80, as shown in FIG. 2. The printed characters can be on the interior surface 70 and or exterior surface 80. The interior surface 70 of the first sheet 20 and second sheet 30 can together form a chamber 40. The edges 90 of the first sheet 20 and second sheet 30 can be joined to one another to form the chamber 40. Within the chamber 40, the substrate treatment agent 50 can be disposed. At least one of the first sheet 20 and second sheet 30 can be a formed sheet 25. At least one of the first sheet 20 and second sheet 30 can be a thermoformed sheet 25. The interior surface 70 of the first sheet 20 and second sheet 30 can be oriented towards the chamber 40. The first plurality 310 of printed characters 300 can be provided on the interior and or exterior surface of any sheet forming the pouch.

The edges 90 can each have a length less than about 100 mm, or even less than about 60 mm, or even less than about 50 mm. The plan view of the of the water soluble pouch 10 can be substantially rectangular, substantially square, substantially circular, elliptical, superelliptical, or any other desired shape that is practical to manufacture. The overall plan area of the water soluble pouch can be less than about 10000 $mm^2$, or even less than about 2500 $mm^2$. Sized and dimensioned as such, the water soluble pouch 10 can fit conveniently within the grasp of an adult human hand. Further, for water soluble pouches 10 intended for use in automatic dishwashing machines, such a size can conveniently fit in the detergent receptacle within the machine.

The edges 90 of the first sheet 20 and second sheet 30 can be bonded to one another. For example, the edges 90 of the first sheet 20 and second sheet 30 can be joined to one another by a thermal bond or a solvent weld or combination thereof. A thermal bond can be formed by applying one or more of heat and pressure to the two materials to be bonded to one another. A solvent weld can be formed by applying a solvent to one or both of the first sheet and second sheet and contacting the first sheet 20 and second sheet 30 in the location at which a bond is desired. For water soluble pouches, the solvent can be water and or steam.

The first sheet 20 and the second sheet 30 can be sufficiently translucent, or even transparent, such that the substrate treatment agent 50 is visible from the exterior of the pouch 10. That is, the consumer using the pouch 10 can see the substrate treatment agent 50 contained in the pouch 10.

The pouch 10 can have a plurality of chambers 40. For example a plurality of pouches 10 can be joined to one another to for a multi-compartment pouch. One or more pouches of the kind illustrated in FIG. 2 can be joined to one another. The pouch 10 can be of the type presently marketed as TIDE PODS, CASCADE ACTION PACS, CASCADE PLATINUM, CASCADE COMPLETE, ARIEL 3 IN 1 PODS, TIDE BOOST ORIGINAL DUO PACs, TIDE BOOST FEBREZE SPORT DUO PACS, TIDE BOOST FEE DUO PACS, TIDE BOOSE VIVID WHITE BRIGHT PACS, DASH, FAIRY (PLATINUM, ALL-IN ONE, YES (PLATINUM ALL-IN ONE, JAR (PLATINUM, ALL-IN ONE, DREFT (PLATINUM, ALL-IN ONE by The Procter & Gamble Company in various geographies globally. The pouch 10 can have 3 chambers 40. The first sheet 20 and second sheet 30 can form a first chamber 40. Another first sheet 20 and second sheet 30 can form a second chamber 40 or one or more additional chambers 40. The two pouches 10 can be joined together. The chambers 40 can be superimposed upon one another. The chambers 40 can be a in a side by side relationship.

The substrate treatment agent 50 can be a liquid or solid. The substrate treatment agent 50 can be selected from the group consisting of laundry detergent, laundry additive, dishwashing detergent, hard surface cleaner, and dishwashing additive.

The pouch 10 can be sized and dimensioned to fit in an adult human hand. The pouch 10 can have a volume less than about 70 mL. The pouch 10 can have a volume less than about 50 mL. The pouch 10 can have a volume less than about 40 mL. The edges 90 can have a length of from about 10 mm to about 70 mm. The edges 90 can have a length of from about 20 mm to about 60 mm. The edges 90 can have a length of from about 25 mm to about 50 mm.

Figure 3:
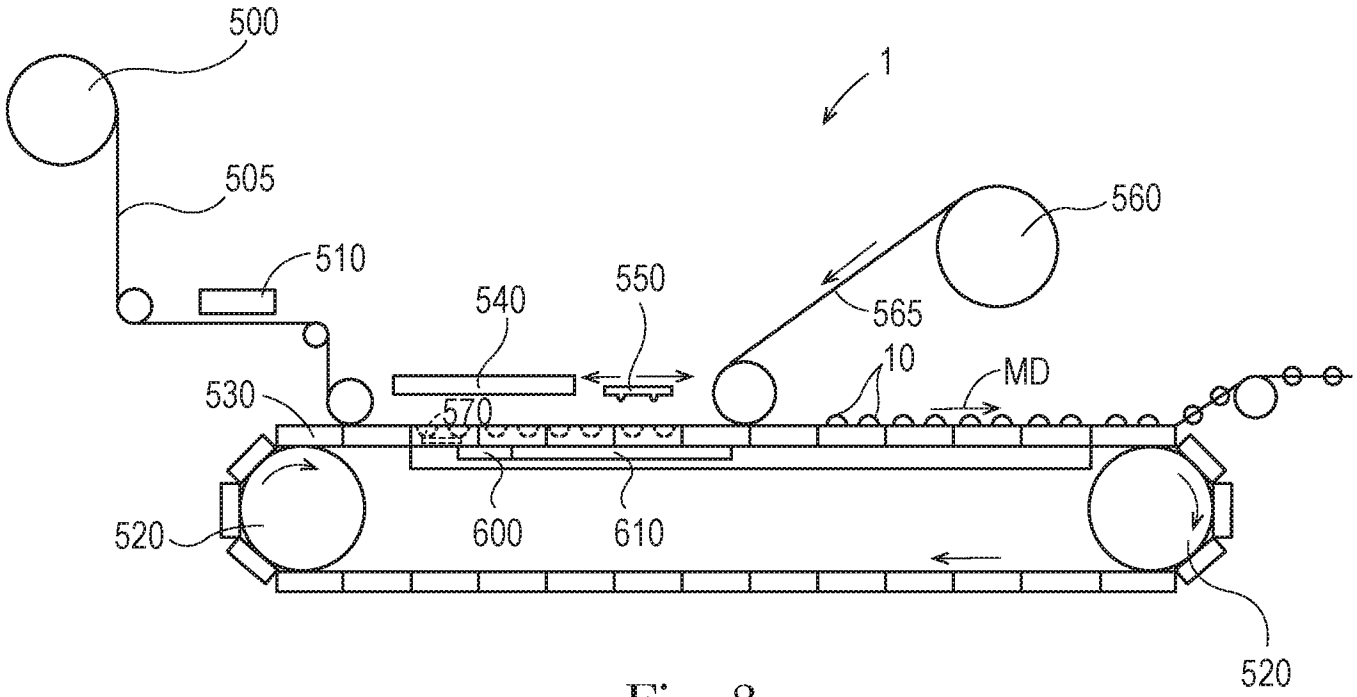
FIG. 3 is an apparatus for making a water soluble pouch.

An apparatus 1 for forming a water soluble pouch 10 is shown in FIG. 3. The apparatus 1 can comprise a first web feed roll 500, a printing unit 510, a conveyor system 520, a plurality of first molds 530 movably mounted on the conveyor system 520, a heater 540, a dispenser 550, and a second web feed roll 560. Upstream of the dispenser 550, the apparatus 1 can comprise a first vacuum system 600 and a second vacuum system 610, the second vacuum system 610 being between the first vacuum system 600 and the dispenser 550. The first web 505 can be fed through the printing unit 510 prior to being place on the conveyor system 520. The printing unit 510 can print the first plurality 310 of adjacent printed characters 300 onto the first web. The first web 505 can then be fed onto the conveyor system 520. The conveyor system 520 can convey the first molds 530 in the machine direction MD. The dispenser 550 can be movable in the machine direction MD and in a direction upstream of the machine direction MD.

The printing unit 510 can be located between the first web feed roll 500 and the conveyor system 520. Optionally the printing unit 510 can be located between the second web feed roll 560 and the conveyor system 520. Optionally, the web feed roll 500 can be a pre-printed web feed roll having the first plurality 310 of adjacent printed characters 300 disposed thereon and the printing unit 510 can be eliminated. Further optionally, the web feed roll 560 can be a pre-printed web feed roll having the first plurality 310 of adjacent printed characters 300 disposed thereon and the printing unit 510 can be eliminated. The first plurality 310 of adjacent printed characters 300 can be on either surface of the first web 505, the second web, and or the third web, and one or more of the such webs.

The conveyor system 520 can convey the first molds 530 and thereby first web 505 at a rate of from about 5 m/min to about 20 m/min, inclusive of any ranges of or single values of integers there between. The conveyor system 520 can be a belt or drum or other structure suitable for conveying first molds 530.

Figure 4:
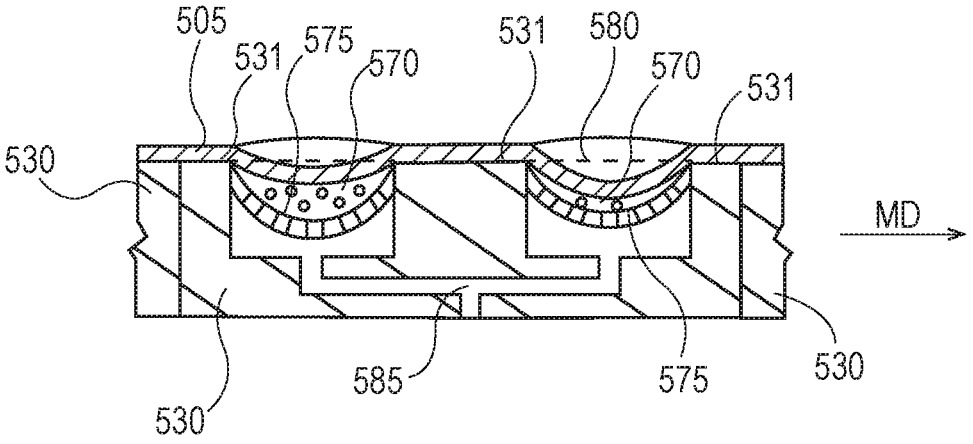
FIG. 4 a cross section of a mold for making a water soluble pouch.

The conveyor system 520 can comprise a plurality of first molds 530. The webs discussed herein can be held on the molds discussed herein by a web-holding vacuum system in the land areas of the molds. A cross section of a first mold 530 is shown in FIG. 4. The first mold 530 and second mold, discussed further herein, can be fabricated from aluminum. A first mold 530 can have one or more first cavities 570. The first cavities 570 can have a first porous face 575. There can be one or more first molds 530 in the cross machine direction. The conveyor system 520 can convey the molds in the machine direction MD during formation and filling of the pouches 10. The first molds 530 can be provided with one or more vacuum transmission systems 585. The first molds 530 can have a vacuum system for holding the first web 505 on the first molds 530. The first molds 530 can have a land area 531 that surrounds the respective cavity, the first cavity or cavities 570 and second cavity or cavities.

The first molds 530 provided can comprise a first cavity 570. As the first web 505 is conveyed in the machine direction MD, the first web 505 can pass beneath a heater 540. The heater 540 can be an infrared lamp. The heater 540 can be an infrared lamp having a temperature of from about 300° C. to about 500° C. As the first web 505 passes beneath the heater 540, the first web 505 can be heated to the desired temperature. The distance between the heater 540 and the first web 505 can be adjustable so that the temperature of the first web 505 can be controlled. Similarly, the temperature of the heater 540 can be adjustable so that the temperature of the first web 505 can be controlled.

As the first web 505 is optionally being heated or after the first web 505 is optionally heated to the desired temperature, the first molds 530 can be conveyed over a first vacuum system 600. The first vacuum system 600 can be used to apply a first negative gage pressure to the first porous face 575 of the first cavity 570. When the first negative gage pressure is applied to the first porous face 575 of the first cavity 570, the first web 505 can be at a first maximum temperature. When the first web 505, and or third web, is heated, it is possible that the temperature of the first web (and or third web as applicable) is non-uniform in the machine direction MD and the cross direction. This can occur because when a web is being carried by a first mold 530 (and or second mold as applicable), part of the web is resting on the land area 531 of the first mold 530 (and or second mold as applicable) and part of the web is overlying the first cavity 570 (and or second cavity as applicable). The difference in boundary conditions for the first web 505 (and or third web as applicable) in the direction of the thickness of the first web 505 (and or third web as applicable) can result in non-uniform heating of the first web 505 (and or third web as applicable). For instance, the portion of a web overlying the center of a cavity may be at a temperature of 107° C. and the portion of the web out on the land area 531 may have a temperature of about 25° C. The portion of a web overlying the center of a cavity may be at a temperature of 103° C. and the portion of the web out on the land area 531 may have a temperature of about 26° C. The portion of a web overlying the center of a cavity may be at a temperature of 108° C. and the portion of the web out on the land area 531 may have a temperature of about 24° C. The maximum temperature as referred to herein is the maximum local temperature of the portion of the web being formed. The maximum temperature as referred to herein can be the maximum local temperature of the portion of the web being thermoformed. A higher temperature of the portion of the web overlying the center of a cavity can promote improved thermoforming resulting in fewer and or less structurally significant microscopic cracks. Further, higher temperatures during thermoforming can promote plastic deformation which can result in less internal pressure of the finished pouch 10 as compared to if the web is elastically deformed. If the temperature is too high, the web may become so pliable that the web may be drawn into holes in the forming surface which can be detrimental to the structural integrity of the finished pouch 10.

The first porous face 575 of the first cavity 570 can comprise openings having an area from about 0.1 $mm^2$ to about 2 $mm^2$. The first porous face 575 of the first cavity 570 can comprise openings having an area from about 0.5 $mm^2$ to about 1 $mm^2$. The first porous face 575 of the first cavity 570 can comprise openings having an area from about 0.5 $mm^2$ to about 1.5 $mm^2$. The openings can be circular openings. There can be from about 2 to about 2000 openings. The openings can be sized such that at the temperature of deformation, plastic deformation, or thermoforming, the web is not drawn into the openings to a degree such that the structural integrity of the finished pouch 10 is compromised.

A first cavity 570 in the first mold 530 can have a volume from about 5 mL to about 300 mL. A first cavity 570 in the first mold 530 can have a volume from about 5 mL to about 40 mL. A first cavity 570 in the first mold 530 can have a volume from about 14 mL to about 18 mL.

The first maximum temperature can be from about 5° C. to about 100° C. The first maximum temperature can be from about 10° C. to about 100° C. The first maximum temperature can be from about 20° C. to about 100° C. The first maximum temperature can be from about 60 to about 100° C.

The first maximum temperature can be such that the deformation of the first web 505 is by thermoforming. Thermoforming may provide for a finished pouch 10 that has lesser degree of micro-cracking as compared to a pouch 10 that is formed from a first web 505 that is deformed at a lower temperature.

The first negative gage pressure can be from about 10 mbar to about 90 mbar below atmospheric pressure. The first web 505 can be subjected to the first negative gage pressure for from about 1 s to about 10 s. The first web 505 can be subjected to the first negative pressure for from about 2 s to about 5 s. The first web 505 can be subjected to the first negative pressure for from about 1 s to about 3 s. The first negative gage pressure can be from about 10 mbar to about 40 mbar below atmospheric pressure. The first negative gage pressure can be from about 25 mbar to about 35 mbar below atmospheric pressure. The water soluble first web 505 can have a temperature of from about 5° C. to about 100° C., or even from about 10° C. to about 100° C., or even from about 20° C. to about 100° C., when the first negative gage pressure is applied to the first web 505. The lower the first negative gage pressure the faster the first web 505 will be deformed. Slower deformation can reduce the amount of micro-cracking in the deformed first web 505. For a lower the temperature of deformation, the first negative gage pressure may be greater, i.e. less vacuum, so that deformation of the first web 505 is slow, which can reduce micro-cracking in the first web 505.

As the first web 505 is conveyed further in the machine direction MD, a second negative gage pressure can be applied to the first porous face 575 of the cavity 570 when the first web 505 is at a second maximum temperature. The second negative gage pressure can be applied with a second vacuum system 610. The second negative gage pressure can be applied when the first web 505 is at a second maximum temperature. The second maximum temperature can be greater than the first maximum temperature.

For clarity, gage pressure is zero referenced at atmospheric pressure. So if the first negative gage pressure is 50 mbar below atmospheric pressure and the second negative gage pressure is 100 mbar below atmospheric pressure, it can be said that the second negative gage pressure is less than the first negative gage pressure. And, it can be said a gage pressure of 50 mbar below atmospheric pressure is a negative gage pressure since it is pressure below atmospheric pressure. Since a negative gage pressure of 50 mbar below atmospheric pressure is below atmospheric pressure, it is a vacuum. So, in the circumstances in which the second negative gage pressure is less than or equal to the first negative gage pressure, it can be thought of as the first negative gage pressure being a first level of vacuum and the second negative gage pressure being a second level of vacuum, and the second level of vacuum is more forceful than the first level of vacuum.

The second maximum temperature can be from about 100° C. to about 120° C. The second negative gage pressure can be from about 150 mbar to about 260 mbar below atmospheric pressure. The second negative gage pressure can be from about 180 mbar to about 260 mbar below atmospheric pressure. The second negative gage pressure can be from about 180 mbar to about 230 mbar below atmospheric pressure. The second negative gage pressure can be from about 210 mbar to about 230 mbar below atmospheric pressure. That is, the second negative gage pressure pulls harder on the first web 505 than the first negative gage pressure.

The first negative gage pressure, second negative gage pressure, first maximum temperature, and second maximum temperature can be selected so that the compartment 580 is well formed, the first web 505 is not drawn into the openings in the first porous face 575 to an unacceptable degree, and the amount of micro-cracking that occurs during deformation of the first web 505 is limited to an acceptable degree. In general, the higher the second temperature, the greater the second negative gage pressure can be since it can be easier to deform the first web 505 at a higher temperature.

The application of the first negative gage pressure and the second negative gage pressure can deform the first web 505 into the one or more first cavities 570 of the first molds 530. The application of the first negative gage pressure and the second negative gage pressure can plastically deform the first web 505 into the one or more first cavities 570 of the first molds 530. The plastic deformation can be provided by thermoforming, thermoforming being considered to be a subset of plastic deformation. The first web 505 can be heated and drawn in to first cavities 570 in the first mold 530, as shown in FIG. 4. The first web 505 heated above ambient temperature can be drawn in by a vacuum applied to the first porous face 575 of the first cavity 570 via a vacuum transmission system 585. The vacuum transmission system 585 of the first molds 530 can be in fluid communication with first vacuum system 600 to apply the first negative gage pressure.

As the first mold 530 is conveyed downstream in the machine direction MD, the first mold 530 can be brought into position such that the second vacuum system 610 can apply the second negative gage pressure to the vacuum transmission system 585 of the first mold 530. The vacuum transmission system 585 of the first molds 530 can be in fluid communication with second vacuum system 610 to apply the second negative gage pressure. The second negative gage pressure generated by the second vacuum system 610 can be applied to the first porous face 575 of the first cavity 570 to further draw in the first web 505 into the cavity 575.

Formation of the compartment 580 in the first web 505 can be a multi-stage process. In the first stage of the process, the first mold 530 is positioned to be operatively engaged with the first vacuum system 600 to apply a first negative gage pressure to the first porous face 575 of the cavity 570 to draw the first web 505 partially into the first cavity 575. In the second stage of the process, the first mold 530 is positioned to be operatively engaged with the second vacuum system 610 to apply a second negative gage pressure to the first porous face 575 of the first cavity 570 to draw the first web 505 further into the first cavity 575. The first web 505 can be at a first maximum temperature when the first negative gage pressure is applied and at a second maximum temperature when the second negative gage pressure is applied, the second maximum temperature being greater than or equal to the first maximum temperature.

After the second negative gage pressure is applied to the first web 505, the thermoformed first web 505 can then be filled or partially filled with the substrate treatment agent 50 by the dispenser 550. The second web 565 is then brought into facing relationship with the molded first web 505 and sealed to the first web 505 to form a pouch 10. The second web 565 can be at a temperature of from about ambient temperature to about 120° C. The second web 565 can be at a temperature of from about 10° C. to about 120° C. The second web 565 can be at a temperature of from about 20° C. to about 120° C.

The substrate treatment agent 50 can be placed on the water soluble first web 505 as part of the process of making a water soluble pouch 10. In terms of the substrate treatment agent 50 being placed on the water soluble first web 505, that can occur prior to deformation of the water soluble first web 505 into a compartment 580, during deformation of the water soluble first web 505 into a compartment 580, or after the water soluble first web 505 has been deformed into a compartment 580, or during part of any of the aforesaid periods or overlapping with any of such periods.

Other approaches to forming the water soluble first web 505 to form a compartment 580 are contemplated. Fundamentally, all that is needed to deform the water soluble first web 505 into a compartment 580 is to apply a difference in pressure across the water soluble first web 505 to conform the water soluble first web 505 to the first porous face 575 of the first cavity 570. For instance, the water soluble first web 505 can be formed into a compartment 580 by applying a first pressure difference across the water soluble first web 505 with the water soluble first web 505 at a first maximum temperature and subsequently applying a second pressure difference across the water soluble first web 505 with the water soluble first web 505 at a second maximum temperature. The second pressure difference can be greater than the first pressure difference. The second maximum temperature can be greater than or equal to the first maximum temperature. The first pressure difference across the water soluble first web 505 can be provided by, by way of non-limiting example, fluid pressure from above the mold. The fluid can be a heated fluid. The fluid pressure that can act on the water soluble first web 505 can be provided by a gas such as air or a liquid. For instance, nozzles can dispense fluid, by way of non-limiting example liquid or gas, under pressure in a direction towards the first web 505 to conform the first web 505 to the first porous face 575 of the first cavity 570.

As described herein, the first pressure difference can be applied by applying a first negative gage pressure to the first porous face 575 and the second pressure difference can be applied by applying a second negative gage pressure to the first porous face 575. The second negative gage pressure can be less than or equal to the first negative gage pressure.

Any suitable process of joining the first web 505 and the second web 565 may be used. The sealing may occur in the land area 531 between individual first cavities 570 of the first molds 530. Non-limiting examples of such means include heat sealing, solvent welding, solvent or wet sealing, and combinations thereof. Heat and or solvent can be applied to the entire surface of the sheet or only the area which is to form the seal can be treated with heat or solvent. The heat or solvent can be applied by any process, typically on the closing material, and typically only on the areas which are to form the seal. If solvent or wet sealing or welding is used, heat can also be applied. Wet or solvent sealing/welding processes include selectively applying solvent onto the area between the molds, or on the closing material, by for example, spraying or printing this onto these areas, and then applying pressure onto these areas, to form the seal. Sealing rolls and belts as described above that optionally also provide heat can be used, for example.

A cutting operation can be integral with or located downstream of the apparatus shown in FIG. 3 to separate the pouches 10 into individual pouches 10. The formed pouches 10 may then be cut by a cutting device. Cutting can be accomplished using any known process. The cutting can be done in continuous manner, optionally with constant speed and in a horizontal position. The cutting device can, for example, be a sharp item or a hot item, whereby in the latter case, the hot item 'burns' through the sheet/sealing area. The cutting device or devices can be a rotary die cutter to make cuts in the cross direction and a cutting wheel to make cuts in the machine direction MD.

From the viewpoint of an individual pouch 10, the process for making the water soluble pouch 10 is a multi-step process. A water soluble first sheet 20 is provided. A water soluble second sheet 30 is provided. A compartment 580 is formed in one of the first sheet 20 and the second sheet 30 by plastically deforming such sheet. A substrate treatment agent 50 can be placed in the compartment 580 or on the first sheet 20. And, the first sheet 20 and the second sheet 30 can be sealed to one another to form an enclosed pouch 10.

In the process of making the pouch 10, at least one of the first sheet 20 and the second sheet 30 is formed. In the process of making the pouch 10, at least one of the first sheet 20 and the second sheet 30 can be thermoformed. In the process of making the pouch 10, at least one of the first sheet 20 and the second sheet 30 can be plastically deformed. In the process of making the pouch 10, at least one of the first sheet 20 and the second sheet 30 can be deformed. Depending on the properties of the sheets forming the pouch 10, a sheet that is thermoformed to form the compartment 580 into which the substrate treatment agent 50 is placed may partially rebound after the sheet is joined to the other sheet. Depending on the properties of the first sheet 20 and the second sheet 30, the pouch 10 can be designed to have more or less curved sheets.

When forming the pouches 10 as described herein, the sheet that is deformed to make the compartment 580 may rebound after the other sheet is joined thereto and the pouch 10 is formed. As the rebounding sheet contracts, the other sheet may be plastically deformed by the increase in pressure within the chamber 40 arising due to the contracting sheet. Thus, it is possible that even though only one sheet is deformed to make the compartment 580, both sheets may be plastically deformed when the sheet initially drawn in to the first cavity 570 rebounds. Heat can optionally be applied to the sheet that was not plastically deformed into the first cavity 570 such that plastic deformation of the other sheet can be by thermoforming as well as by way of the rebounding of the one sheet driving deformation of the other sheet.

A first cavity 570 in the first mold 530 can have a surface area from about 20 to about 80 $cm^2$. As the first web 505 is transformed into a compartment 580, the deformed, plastically deformed, or thermoformed portion of the first web 505 can increase in area from about 50 to about 300% as compared to the area of the portion of the first web 505 subject to deformation, plastic deformation, or thermoforming prior to deformation, plastic deformation, or thermoforming.

Figure 5:
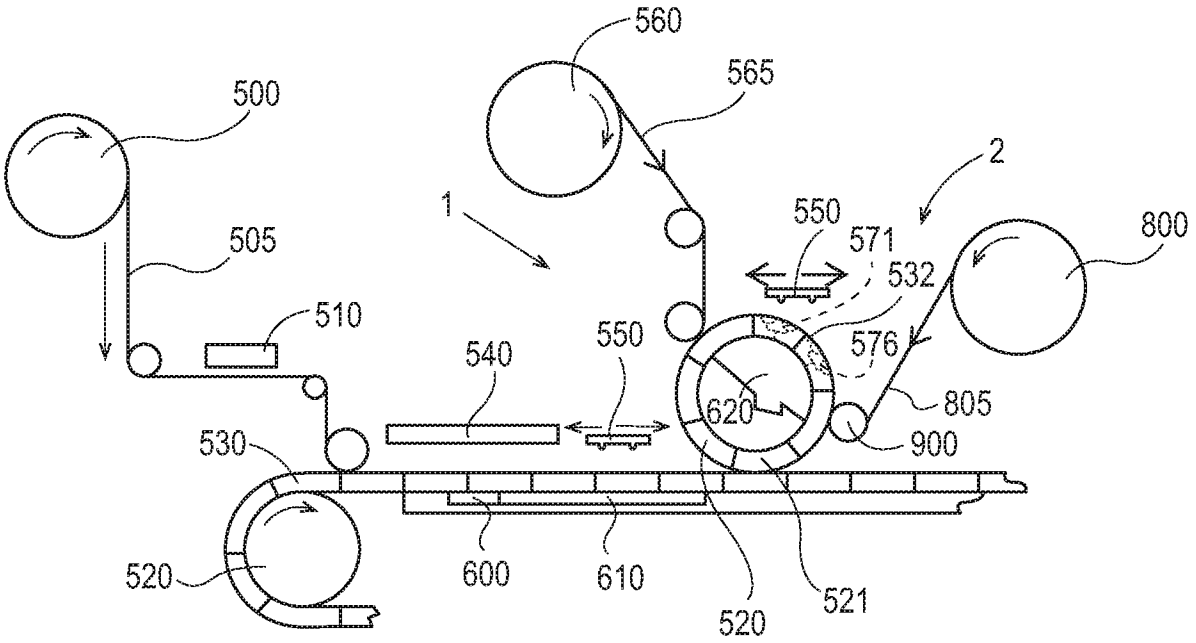
FIG. 5 is an apparatus for making a water soluble pouch.

If more than one pouch 10 are to be joined to one another, the apparatus 1 can be provided with a top pouch forming device 2, as shown in FIG. 5. In such an arrangement the bottom pouch 10 can be formed as described above with respect to forming pouches 10. The top pouch forming device 2 can comprise a third web feed roll 800. A water soluble third web 805 can be provided from the third web feed roll 800. The third web 805 can be carried on a heated roller 900. The heated roller 900 can heat the third web 805 to a temperature of from about 100° C. to about 135° C. The heated roller 900 can heat the third web 805 to a temperature of from about 100° C. to about 125° C. The higher the temperature of the third web 805, the greater the propensity for the deformation to be by thermoforming.

The third web 805 can be carried on a second mold 532 on a conveyor system 520. The conveyor system 520 for the third web 805 can be a belt system as shown in FIG. 3 for first molds 530. The conveyor system 520 for the third web 805 can be a rotating drum system as shown in FIG. 5. As shown in FIG. 5, a belt system can be used to convey the first web 505 and first molds 530 used to form the first web 505. A belt system can be used to convey the third web 805 and second molds 532 used to form by deformation, plastic deformation, or thermoforming, the third web 805. In a drum system, the second molds 532 can be mounted on or formed in a rotating drum 521 and can be used to thermoform the third web 805.

The second molds 532 and first molds 530 are fundamentally structured in the same manner as one another. The second molds 532 comprise at least one second cavity 571. The second molds comprise a vacuum transmission system 585. The second mold 532 can comprise second porous face 576. The second porous face 576 differs from the first porous face 575 in that the second porous face 576 is part of the second mold 532 rather than the first mold 530. The second porous face 576 can have a different shape than the first porous face 575, different size openings in the porous face 576 to connect the second cavity to the vacuum transmission system 585, different land area 531, and different volume, among other possible differences. The second mold 532 can comprise a land area 531. The second porous face 576 of the second cavity 571 can comprise openings having an area from about 0.1 $mm^2$ to about 2 $mm^2$. The second porous face 576 of the second cavity 571 can comprise openings having an area from about 0.5 $mm^2$ to about 1 $mm^2$. The openings can be circular openings. There can be from about 2 to about 2000 openings.

The difference between the second molds 532 and first molds 530 can be in the shape of the cavity or cavities of each respective mold. Further, a difference between the second molds 532 and first molds 530 can be the shape of the underside of the respective mold so that such mold can conform, be attached to, or fit with the conveyor system 520. So FIG. 4 is representative of a second mold 532 and a first mold 530. The second mold 532 can comprise a third cavity next to the second cavity 571. The second cavity 571 and third cavity can be associated with a single pouch 10 formed in the first cavity. Arranged as described herein, the final product can comprise, two pouches 10 joined to one another, three pouches 10 joined to one another, or any other such number of pouches 10 desirable.

The rotating drum 521 can be heated. Heat can be conducted to the second molds 532. The rotating drum can have a temperature of from about 25 to about 70° C. The temperature of the rotating drum can be set so that the temperature of the third web 805 is from about 100 to about 135° C. when the third web is carried on the second molds 532 mounted on the rotating drum 521. A belt system can be used in place of the rotating drum 521.

The interior of the rotating drum can be provided with a third vacuum system 620. The third vacuum system 620 can be in fluid communication with the second porous face 576 of the second cavity 571 of the second mold 532 via a vacuum transmission system 585. As the third web 805 is carried on the second mold 532 by the conveyor system 520, a third negative gage pressure is applied to the second porous face 576 and thereby to the third web 805. The third negative gage pressure can deform the third web 805 into the second cavity 571 of the second mold 532. The deformation of the third web 805 can be by plastic deformation. The deformation of the third web can be by thermoforming. The third web 805 can be at a temperature of from about 100° C. to about 135° C. when the third negative gage pressure is applied to the second porous face 576. The third web 805 can be at a temperature of from about 100° C. to about 125° C. when the third negative gage pressure is applied to the second porous face 576.

The third web 805 can be formed into a second compartment 580 by applying a third pressure difference across the water soluble third web 805. The third pressure difference can be applied by applying a third negative gage pressure to the second porous face 576. The third pressure difference across the water soluble third web 805 can be provided by, by way of non-limiting example, fluid pressure from above the second mold 532. The fluid can be a heated fluid. The fluid pressure that can act on the water soluble third web 805 can be provided by a gas such as air or a liquid. For instance, nozzles can dispense fluid, by way of non-limiting example liquid or gas, under pressure in a direction towards the third web 805 to conform the third web 805 to the second porous face 576 of the second cavity 571.

Once a second compartment 580 is formed in the third web 805, a substrate treatment agent can be placed in the second compartment 580. The second compartment 580 can be filled or partially filled with a substrate treatment agent 50. Filling or partial filling can be provided by a dispenser 550. Filling can occur when the second compartment 580 is proximal the apex of its travel path. If the second mold 532 is conveyed on a drum system, filling may occur when the second mold 532 is proximal it highest elevation. If the second mold 532 is conveyed on a belt system, filling can be provided at a location at or downstream of where the second compartment 580 is formed. The dispenser 550 associated with the second mold 532 can travel with the conveyor system 520 for at least part of the range of motion of the conveyor system. For instance, the dispenser 550 that fills the second compartment 580 formed in the third web 805 can travel back and forth over a limited range of motion as shown in FIG. 5. After the second compartment 580 in the third web 805 is filled, the second web 565 is then sealed to the formed third web 805 to form a second enclosed pouch 10 having a second chamber 40. The formed third web 805 can be a deformed, plastically deformed, or thermoformed.

The second substrate treatment agent 50 can be placed on the water soluble third web 805 as part of the process of making a water soluble pouch 10. In terms of the second substrate treatment agent 50 being placed on the water soluble third web 805, that can occur prior to deformation of the water soluble third web 805 into a second compartment 580, during deformation of the water soluble third web 805 into a second compartment 580, or after the water soluble third web 805 has been deformed into a second compartment 580, or during part of any of the aforesaid periods or overlapping with any of such periods.

Any suitable process of sealing the second web 565 and the third web 805 may be used. The sealing may occur in the landing areas between individual second cavities 571 of the second molds 532. Non-limiting examples of such means include heat sealing, solvent welding, solvent or wet sealing, and combinations thereof. Heat and or solvent can be applied to the entire surface of the sheet or only the area which is to form the seal is treated with heat or solvent. The heat or solvent can be applied by any process, typically on the closing material, and typically only on the areas which are to form the seal. If solvent or wet sealing or welding is used, heat can also be applied. Wet or solvent sealing/welding processes include selectively applying solvent onto the area between the molds, or on the closing material, by for example, spraying or printing this onto these areas, and then applying pressure onto these areas, to form the seal. Sealing rolls and belts as described above that optionally also provide heat can be used, for example.

The pouch 10 formed between the third web 805 and the second web 565 can then be joined with the first web 505 to form the pouch 10 between the second web 565 and the first web 505. The second web 565 and the first web 505 can be joined to one another as described previously.

The second molds 532 used to form the third web 805 into second compartments 580 can have second cavities 571 having the same shape or different shape as the first molds 530 used to form the first web 505. The second molds 532 used to form the third web 805 into compartments 580 can have one or more second cavities 571 having a volume from about 0.5 mL to about 10 mL. The second molds 532 used to form the third web 805 into second compartments 580 can have one or more second cavities 571 having a surface area of from about 100 to about 1500 $mm^2$.

The substrate treatment agent 50 can be a liquid, but may be a solid or tablet. By the term 'liquid' it is meant to include liquid, paste, waxy or gel compositions. A liquid substrate treatment agent 50 may comprise a solid. Solids may include powder or agglomerates, such as micro-capsules, beads, noodles or one or more pearlised balls or mixtures thereof. Such a solid element may provide a technical benefit, through the wash or as a pre-treat, delayed or sequential release component. Alternatively it may provide an aesthetic effect. The substrate treatment agents 50 of the present invention may comprise one or more of the ingredients discussed below.

The substrate treatment agent 50 of the present invention can comprise a surfactant. The total surfactant level may be in the range of from about 1% to about 80% by weight of the substrate treatment agent 50. The substrate treatment agent 50 can comprise linear alkylbenzene sulfonates and or alcoholethoxy sulfate and or C12-16 Pareth-9 and or fatty acid salts and or enzyme and or sodium carbonate and or sodium percarbonate and or methyl glycine diacetic acid, trisodium salt and or alcohol alkoxylate.

The substrate treatment agent 50 can be selected from the group consisting of liquid laundry detergent, a powdered laundry detergent, a liquid dishwashing detergent, a powder dishwashing detergent, a liquid bleaching agent, a powdered bleaching agent, a liquid fabric softener, a powdered fabric softener, a liquid laundry scent additive, a powder laundry scent additive, a liquid fabric care benefit agent, and a solid fabric care benefit agent. The substrate treatment agent 50 can be a fabric softener comprising a quaternary ammonium salt and or a dehydrogenated tallow dimethyl ammonium chloride and or a diethyl ester dimethyl ammonium chloride. A substrate treatment agent 50 can be formulated to treat a substrate selected from the group consisting of glassware, dishware, flooring, textiles, tires, automobile bodies, teeth, dentures, skin, fingernails, toenails, hair, appliance surfaces, appliance interiors, toilets, bathtubs, showers, mirrors, deck materials, windows, and the like.

The first web 505, second web 565, and third web 805 can be a water soluble material. The water soluble material can be a polymeric material that can be formed into a sheet or film. The sheet material can, for example, be obtained by casting, blow-molding, extrusion or blown extrusion of the polymeric material, as known in the art.

The first web 505, second web 565, and or third web 805 disclosed anywhere herein can be a printed web. Similarly, any of the sheets forming the pouch 10 can be printed sheets. The printing of the web or sheet can be on any surface thereof. The printing can be text and or graphics. The printing can provide information as required by regulations governing products sold in particular geographies. The printing can provide usage instructions. The first web 505, second web 565, and or third web 805 and any sheet or sheets of a pouch 10 disclosed anywhere herein can comprise an aversive agent that makes one or more of such webs have a foul taste, foul odor, or unattractive texture. The foul taste can be a bitter taste or hot taste, by way of non-limiting example. Any of the webs or sheets disclosed herein can have both printing and or an aversive agent as disclosed herein in any arrangement disclosed herein.

The first web 505, second web 565, and third web 805 can have a thickness of from about 20 to about 150 microns, or even about 35 to about 125 microns, or even about 50 to about 110 microns, or even about 76 microns or even about 90 microns.

The first web 505, second web 565, third web 805, first sheet 20, and second sheet 30 can have a water-solubility of at least 50%, or even at least 75%, or even at least 95%, as measured by the method set out hereafter using a glass-filter with a maximum pore size of 20 microns: 50 grams±0.1 gram of sheet material is added in a pre-weighed 400 ml beaker and 245 ml±1 ml of distilled water is added. This is stirred vigorously on a magnetic stirrer, labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Suitable polymers, copolymers or derivatives thereof suitable for use as the first web 505, second web 565, and third web 805 and pouch 10 material can be selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. Suitable polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and suitably selected from polyvinyl alcohols, polyvinyl alcohol copolymers and hydroxypropyl methyl cellulose (HPMC), and combinations thereof. The level of polymer in the sheet material, for example a PVA polymer, can be at least 60%. The polymer can have any weight average molecular weight, such as from about 1000 to about 1,000,000, or even from about 10,000 to about 300,000, or even from about 20,000 to about 150,000.

Mixtures of polymers can also be used as the first web 505, second web 565, and third web 805, and as the pouch 10 material. This can be beneficial to control the mechanical and/or dissolution properties of the compartments or sheet, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000 to about 40,000, or even about 20,000, and of PVA or copolymer thereof, with a weight average molecular weight of about 100,000 to about 300,000, or even about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1 to about 35% by weight polylactide and about 65% to about 99% by weight polyvinyl alcohol. Suitable for use herein are polymers which are from about 60% to about 98% hydrolysed, or even about 80% to about 90% hydrolysed, to improve the dissolution characteristics of the material.

The first web 505, second web 565, and third web 805, and pouch 10 material can exhibit good dissolution in cold water, meaning unheated distilled water. Such films can exhibit good dissolution at a temperature of about 24° C., or even about 10° C. By good dissolution it is meant that the sheet exhibits water-solubility of at least about 50%, or even at least about 75%, or even at least about 95%, as measured by the method set out herein and described above.

Suitable first web 505, second web 565, and third web 805 can be webs supplied by Monosol under the trade references M8630, M8900, M8779, M8310, films described in U.S. Pat. Nos. 6,166,117 and 6,787,512 and PVA films of corresponding solubility and deformability characteristics. Further suitable sheets can be those described in US2006/0213801, WO 2010/119022 and U.S. Pat. No. 6,787,512.

Suitable first web 505, second web 565, and third web 805, and pouch 10 materials can be those resins comprising one or more PVA polymers. The water soluble sheet resin can comprise a blend of PVA polymers. For example, the PVA resin can include at least two PVA polymers, wherein as used herein the first PVA polymer has a viscosity less than the second PVA polymer. A first PVA polymer can have a viscosity of at least 8 centipoise (cP), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20° C. All viscosities specified herein in cP should be understood to refer to the viscosity of 4% aqueous polyvinyl alcohol solution at 20° C., unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 30 wt % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt % of a first PVA polymer that has a viscosity in a range of about 10 to about 15 cP and a degree of hydrolysis in a range of about 84% to about 92%. Another type of embodiment is characterized by the PVA resin including about 45 to about 55 wt % of the first PVA polymer that has a viscosity in a range of about 10 to about 15 cP and a degree of hydrolysis in a range of about 84% to about 92%. The PVA resin can include about 15 to about 60 wt % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt % of the second PVA polymer.

When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

The PVA resin can have a weighted, average degree of hydrolysis ($\overline{H^{\circ}}$) between about 80 and about 92%, or between about 83 and about 90%, or about 85 and 89%. For example, $\overline{H^{\circ}}$ for a PVA resin that comprises two or more PVA polymers is calculated by the formula $\overline{H^{\circ}}=\Sigma(Wi \cdot H_i)$ where $W_i$ is the weight percentage of the respective PVA polymer and a $H_i$ is the respective degrees of hydrolysis. Still further it can be desirable to choose a PVA resin that has a weighted log viscosity ($\overline{\mu}$) between about 10 and about 25, or between about 12 and 22, or between about 13.5 and about 20. The $\overline{\mu}$ for a PVA resin that comprises two or more PVA polymers is calculated by the formula $\overline{\mu}=e^{\Sigma W_i \cdot ln\ \mu_i}$ where $\mu_i$ is the viscosity for the respective PVA polymers.

Yet further, it can be desirable to choose a PVA resin that has a Resin Selection Index (RSI) in a range of about 0.255 to about 0.315, or about 0.260 to about 0.310, or about 0.265 to about 0.305, or about 0.270 to about 0.300, or about 0.275 to about 0.295, or about 0.270 to about 0.300. The RSI is calculated by the formula; $\Sigma(W_i|\mu_i-\mu_t|)/\Sigma(W_i\mu_i)$, wherein $\mu_t$ is seventeen, $\mu_i$ is the average viscosity each of the respective PVOH polymers, and $W_i$ is the weight percentage of the respective PVOH polymers.

Also suitable are water soluble first web 505, water soluble second web 505, and water soluble third 805, and pouch 10 materials or sheets comprising a least one negatively modified monomer with the following formula:

$$[Y]-[G]_n$$

wherein Y represents a vinyl alcohol monomer and G represents a monomer comprising an anionic group and the index n is an integer of from 1 to 3. G can be any suitable comonomer capable of carrying of carrying the anionic group, optionally G is a carboxylic acid. G can be selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid and mixtures thereof.

The anionic group of G can be selected from the group consisting of $OSO_3M$, $SO_3M$, $CO_2M$, $OCO_2M$, $OPO_3M_2$, $OPO_3HM$ and $OPO_2M$. Suitably, the anionic group of G can be selected from the group consisting of $OSO_3M$, $SO_3M$, $CO_2M$, and $OCO_2M$. Suitably, the anionic group of G can be selected from the group consisting of $SO_3M$ and $CO_2M$.

Naturally, different webs (first web 505, second web 565, and third web 805), sheet material and/or sheets of different thickness may be employed in making the compartments of the present invention. A benefit in selecting different films is that the resulting compartments may exhibit different solubility or release characteristics.

The web (first web 505, second web 565, and third web 805) and sheet material herein can also comprise one or more additive ingredients. For example, it can be beneficial to add plasticizers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making a water soluble pouch comprising the steps of:

providing a first mold comprising a first cavity, wherein said first cavity comprises a first porous face;

providing a water soluble first web carried on said first mold;

forming said water soluble first web to form a compartment by applying a first pressure difference across said water soluble first web with said water soluble first web at a first maximum temperature and subsequently applying a second pressure difference across said water soluble first web, wherein said second pressure difference is greater than or equal to said first pressure difference;

placing a substrate treatment agent on said water soluble first web;

providing a water soluble second web; and sealing said first web and said second web to one another to form an enclosed pouch having a chamber containing said substrate treatment agent;

wherein said water soluble first web is at a second maximum temperature when said second pressure difference is applied;

wherein said second maximum temperature is greater than said first maximum temperature; and wherein said first maximum temperature is from about 40° C. to about 100° C.

2. The process of making a water soluble pouch according to claim 1, wherein said second maximum temperature is from about 100° C. to about 120° C.

3. The process of making a water soluble pouch according to claim 1, wherein said first pressure difference is applied by applying a first negative gage pressure to said first porous face and wherein said second pressure difference is applied by applying a second negative gage pressure to said first porous face, wherein said second negative gage pressure is less than or equal to said first negative gage pressure.

4. The process of making a water soluble pouch according to claim 3, wherein the step of forming said water soluble first web to form said compartment is performed by thermoforming said water soluble first web to form said compartment.

5. The process of making a water soluble pouch according to claim 4, wherein the step of placing said substrate treatment agent on said water soluble first web is performed by placing said substrate treatment agent in said compartment.

6. The process of making a water soluble pouch according to claim 3, wherein said first negative gage pressure is from about 10 mbar to about 90 mbar below atmospheric pressure.

7. The process of making a water soluble pouch according to claim 3, wherein said second negative gage pressure is from about 150 mbar to about 260 mbar below atmospheric pressure.

8. The process of making a water soluble pouch according to claim 3, wherein said first cavity has a surface area of from about 20 $cm^2$ to about 80 $cm^2$.

9. The process of making a water soluble pouch according to claim 3, wherein said first negative gage pressure and said second negative gage pressure are individually applied for from about 1 s to about 10 s.

10. The process of making a water soluble pouch according to claim 3, wherein said first web is provided at a thickness of from about 20 μm to about 150 μm.

11. The process of making a water soluble pouch according to claim 3, wherein said substrate treatment agent is a liquid, powder, or gel and said substrate treatment agent is selected from the group consisting of laundry detergent, laundry additive, dishwashing detergent, hard surface cleaner, and dishwashing additive.

12. The process of making a water soluble pouch according to claim 3, further comprising the steps of:

providing a second mold comprising a second cavity, wherein said second cavity comprises a second porous face;

providing a water soluble third web carried on said second mold;

forming said water soluble third web to form a second compartment by applying a third pressure difference across said water soluble third web;

placing a second substrate treatment agent on said water soluble third web;

sealing said second web to said water soluble third web to form an enclosed pouch having a second chamber containing said second substrate treatment agent.

13. The process of making a water soluble pouch according to claim 12, wherein said third pressure difference is applied by applying a third negative gage pressure to said second porous face.

14. The process of making a water soluble pouch according to claim 13, wherein said step of forming said second compartment by applying said third pressure difference across said water soluble third web is performed by thermoforming with said water soluble third web at a temperature of from about 100° C. to about 135° C.

15. The process of making a water soluble pouch according to claim 3, wherein said pouch comprises a plurality of printed characters or an aversive agent having a foul taste.

16. A process of making a water soluble pouch comprising the steps of:

providing a first mold comprising a first cavity, wherein said first cavity comprises a first porous face;

providing a water soluble first web carried on said first mold;

forming said water soluble first web to form a compartment by applying a first pressure difference across said water soluble first web with said water soluble first web at a first maximum temperature and subsequently applying a second pressure difference across said water soluble first web, wherein said second pressure difference is greater than or equal to said first pressure difference;

placing a substrate treatment agent on said water soluble first web;

providing a water soluble second web; and sealing said first web and said second web to one another to form an enclosed pouch having a chamber containing said substrate treatment agent;

wherein said water soluble first web is at a second maximum temperature when said second pressure difference is applied and wherein said second maximum temperature is greater than said first maximum temperature;

wherein the first maximum temperature is from about 40° C. to about 100° C. and said second maximum temperature is from about 100° C. to about 120° C.;

wherein said first pressure difference is applied by applying a first negative gage pressure to said first porous face and wherein said second pressure difference is applied by applying a second negative gage pressure to said first porous face, wherein said second negative gage pressure is less than or equal to said first negative gage pressure; and wherein the step of forming said water soluble first web to form said compartment is performed by thermoforming said water soluble first web to form said compartment.

17. The process of making a water soluble pouch according to claim 16, further comprising the steps of:

providing a second mold comprising a second cavity, wherein said second cavity comprises a second porous face;

providing a water soluble third web carried on said second mold;

forming said water soluble third web to form a second compartment by applying a third pressure difference across said water soluble third web;

placing a second substrate treatment agent on said water soluble third web;

sealing said second web to said water soluble third web to form an enclosed pouch having a second chamber containing said second substrate treatment agent.

* * * * *